US007942297B2

(12) United States Patent
Ho et al.

(10) Patent No.: US 7,942,297 B2
(45) Date of Patent: May 17, 2011

(54) FAN MOTOR FOR COMBUSTION-POWERED TOOL

(75) Inventors: Jung-Mao Ho, Taichung (TW); Chang-Sheng Lin, Taichung (TW); Sheng-Man Wang, Taichung (TW)

(73) Assignee: Basso Industry Corp., Taichung (TW)

( * ) Notice: Subject to any disclaimer, the term of this patent is extended or adjusted under 35 U.S.C. 154(b) by 245 days.

(21) Appl. No.: 12/386,878

(22) Filed: Apr. 24, 2009

(65) Prior Publication Data

US 2010/0080717 A1 Apr. 1, 2010

(30) Foreign Application Priority Data

Sep. 26, 2008 (TW) ..... 97137199 A

(51) Int. Cl.
*B25C 1/14* (2006.01)

(52) U.S. Cl. ..... 227/10; 227/130; 123/46 SC

(58) Field of Classification Search ..... 227/10, 227/8, 156, 130; 123/46 SC
See application file for complete search history.

(56) References Cited

U.S. PATENT DOCUMENTS

| | | | | | |
|---|---|---|---|---|---|
| 4,483,474 | A * | 11/1984 | Nikolich | 227/8 |
| 5,558,264 | A * | 9/1996 | Weinstein | 227/10 |
| 5,713,313 | A * | 2/1998 | Berry | 123/46 SC |
| 6,262,504 | B1 * | 7/2001 | Bartlett | 310/89 |
| 6,520,397 | B1 * | 2/2003 | Moeller | 227/130 |
| 6,619,527 | B1 * | 9/2003 | Moeller | 227/10 |
| 7,118,018 | B2 * | 10/2006 | Turk | 227/10 |
| 7,140,331 | B1 * | 11/2006 | Heinzen | 123/46 SC |
| 7,387,092 | B2 * | 6/2008 | Nishikawa et al. | 123/46 SC |
| 7,500,587 | B2 * | 3/2009 | Akiba et al. | 227/10 |

* cited by examiner

*Primary Examiner* — Scott A. Smith
(74) *Attorney, Agent, or Firm* — Kilpatrick Townsend & Stockton LLP

(57) ABSTRACT

A fan motor is adapted to be mounted in a combustion-powered tool. The combustion-powered tool has a housing. The fan motor includes a fan unit, a motor for driving the fan unit, a vibration-absorbing unit, and a clamping unit. The vibration-absorbing unit includes a rigid support that is adapted to be mounted fixedly in the housing of the combustion-powered tool, and an elastic member sleeved over the motor and molded on the rigid support such that the rigid support is disposed around the elastic member. The elastic member is disposed between the rigid support and the motor for absorbing vibrations generated by the motor. The clamping unit includes at least one clamping member sleeved over the elastic member for clamping and retaining the elastic member on the motor.

5 Claims, 4 Drawing Sheets

FAN MOTOR FOR COMBUSTION-POWERED TOOL

CROSS-REFERENCE TO RELATED APPLICATION

This application claims priority to Taiwanese Application No. 097137199, filed Sep. 26, 2008, the disclosure of which is incorporated herein by reference.

BACKGROUND OF THE INVENTION

1. Field of the Invention

The invention relates to a fan motor for use in a combustion-powered tool, more particularly to improvements relating to a fan motor capable of absorbing operationally-induced vibrations in a combustion-powered tool.

2. Description of the Related Art

Taiwanese Patent Publication Number 401342 discloses a combustion-powered tool that has a conventional fan motor. Referring to FIG. 1, the conventional fan motor includes a housing 11, a fan unit 12 installed in the housing 11, a motor 13, and a suspension unit 14 for absorbing vibrations induced by the motor 13. The motor 13 is used to drive the fan unit 12 and has an annular groove 131 formed in an outer surface thereof. The suspension unit 14 includes a rigid support 141 that is fixedly mounted in the housing 11, a rigid ring 142 received within the annular groove 131 of the motor 13, an elastic support 143 disposed between the rigid support 141 and the rigid ring 142, and a pair of clampers (not shown) respectively abutting against two opposite sides of the rigid ring 142 and received in the annular groove 131 of the motor 13.

One problem associated with such a structure is that the suspension unit 14 requires a complicated assembly of many components including the rigid support 141, the rigid ring 142, the elastic support 143, and the clampers (not shown). In addition, it is difficult to mold two separate pieces (i.e., the elastic support 143 on the rigid support 141 and the rigid ring 142.)

SUMMARY OF THE INVENTION

Therefore, an object of the present invention is to provide a fan motor that can overcome the above drawbacks of the prior art.

According to the present invention, a fan motor is adapted to be mounted in a combustion-powered tool. The combustion-powered tool has a housing. The fan motor includes a fan unit, a motor for driving the fan unit, a vibration-absorbing unit, and a clamping unit. The vibration-absorbing unit includes a rigid support that is adapted to be mounted fixedly in the housing of the combustion-powered tool, and an elastic member sleeved over the motor and molded on the rigid support such that the rigid support is disposed around the elastic member. The elastic member is disposed between the rigid support and the motor for absorbing vibrations generated by the motor. The clamping unit includes at least one clamping member that is sleeved over the elastic member for clamping and retaining the elastic member on the motor.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 2:
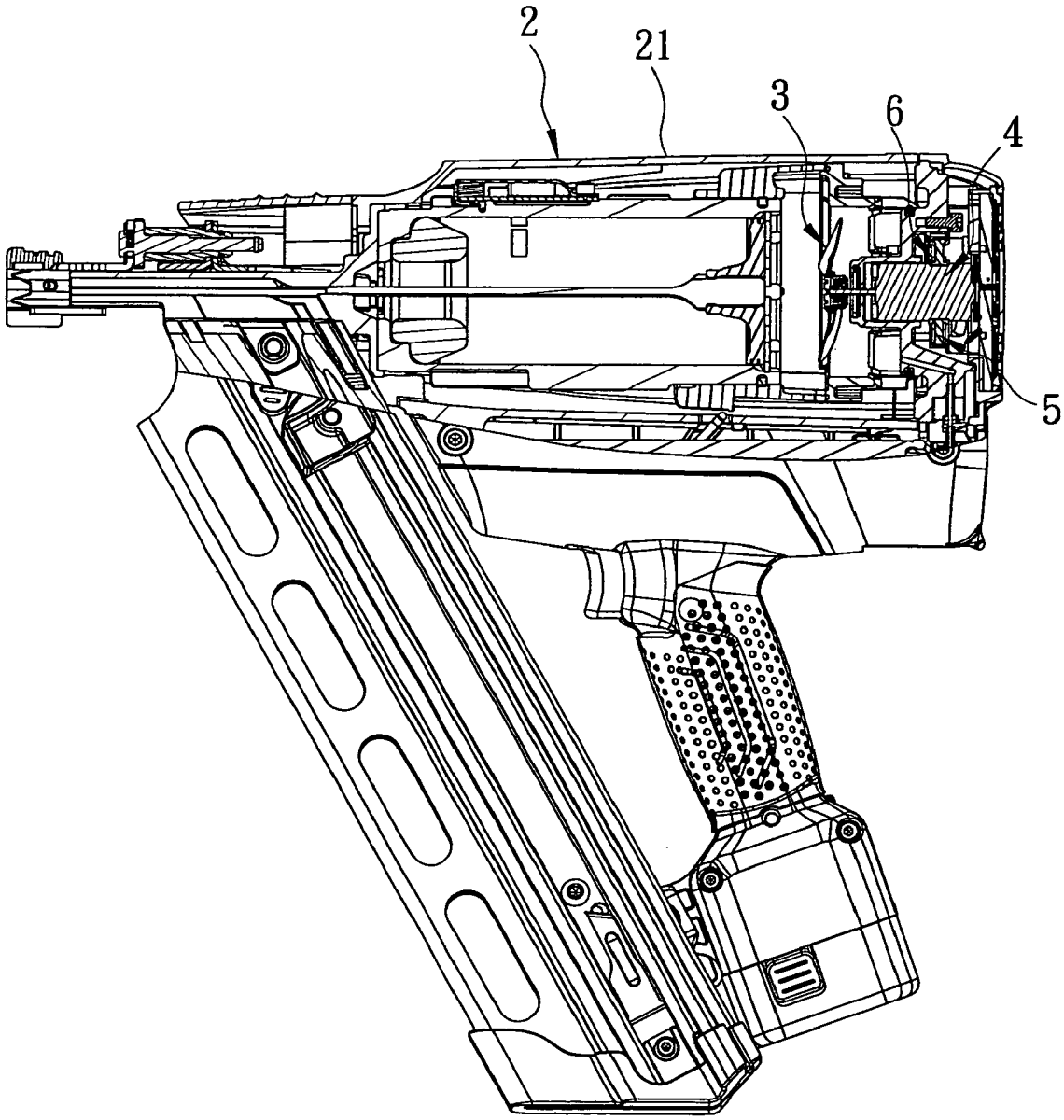
FIG. 2 is a schematic sectional view of the preferred embodiment of a fan motor according to the present invention that is adapted to be mounted in a housing of a combustion-powered tool.
Figure 3:
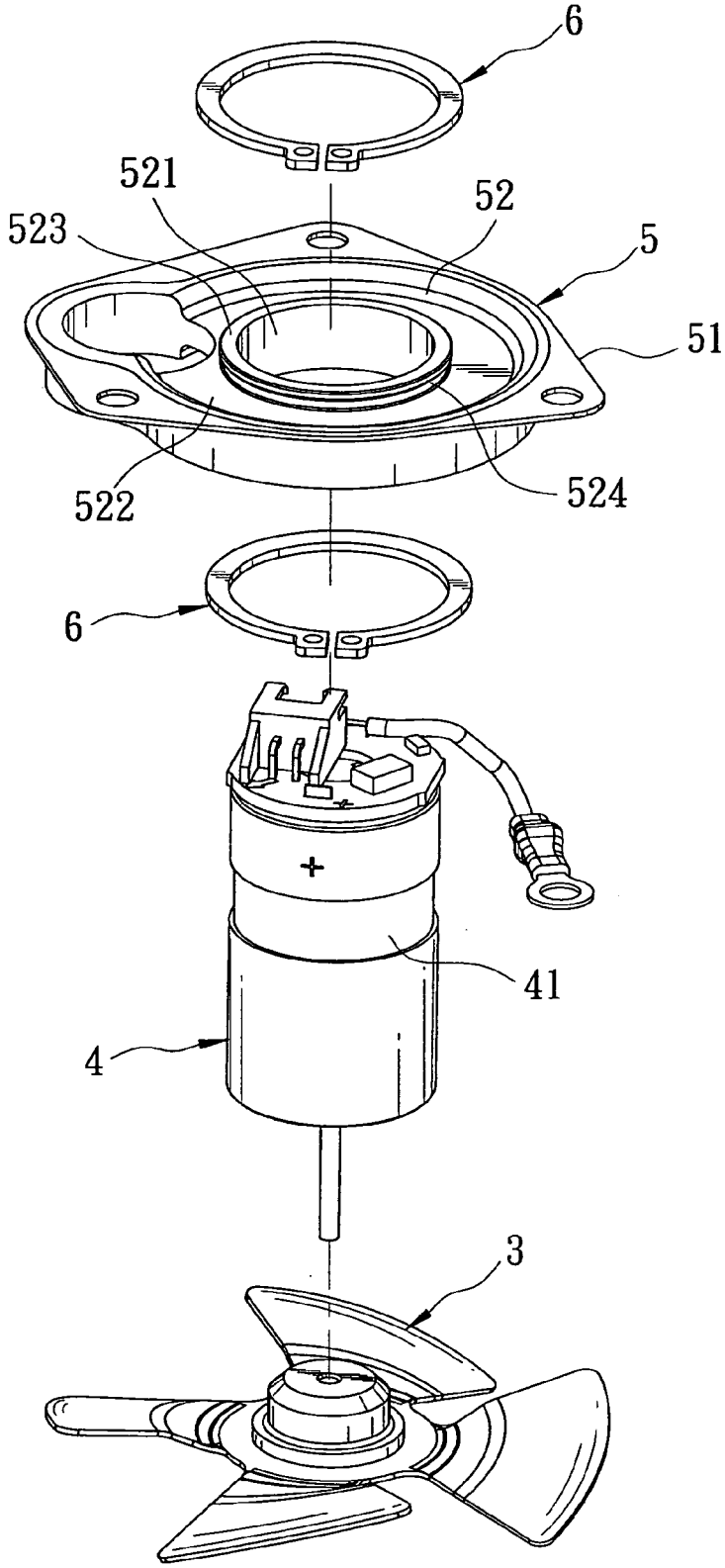
FIG. 3 is an exploded perspective view of the preferred embodiment of the fan motor.
Figure 4:
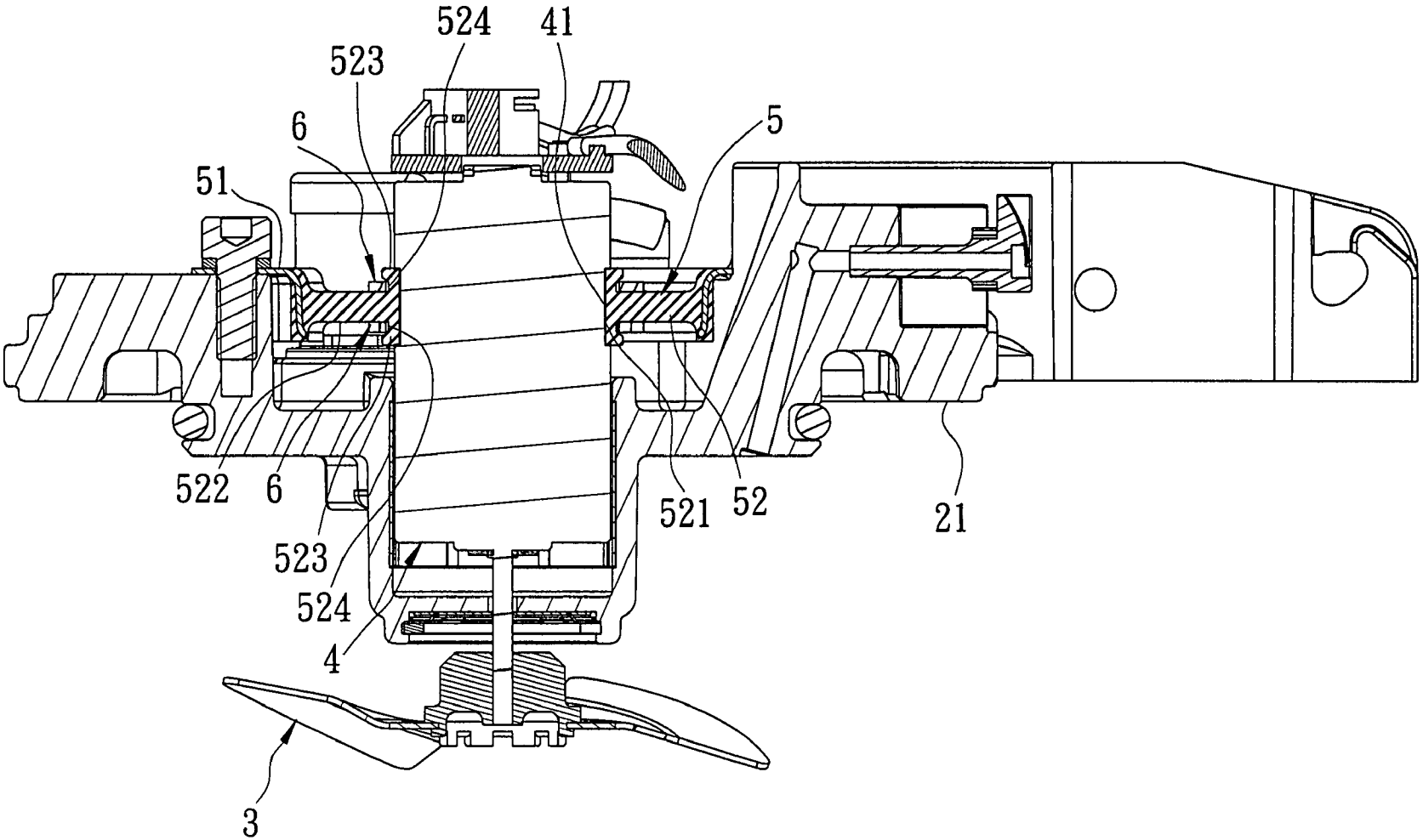
FIG. 4 is a sectional view of the preferred embodiment of the fan motor.

Referring to FIGS. 2 to 4, the preferred embodiment of a fan motor according to the present invention is adapted to be mounted in a combustion-powered tool 2. The combustion-powered tool 2 has a housing 21. The fan motor includes a fan unit 3, a motor 4 for driving the fan unit 3, a vibration-absorbing unit 5, and a clamping unit. The vibration-absorbing unit 5 includes a rigid support 51 that is adapted to be mounted fixedly in the housing 21 of the combustion-powered tool 2 (see FIG. 2), and a unitary elastic member 52 sleeved over the motor 4 and molded on the rigid support 51 such that the rigid support 51 is disposed around the elastic member 52. The elastic member 52 is disposed between the rigid support 51 and the motor 4 for absorbing vibrations generated by the motor 4 during operation of the combustion-powered tool 2. The clamping unit includes two clamping members 6 that are sleeved over the elastic member 52 for clamping and retaining the elastic member 52 on the motor 4.

The elastic member 52 includes a ring plate 522 that has top and bottom surfaces, a through-hole 521 formed through a center of the ring plate 522, a pair of necks 523 respectively formed on inner peripheries of the top and bottom surfaces of the ring plate 522, and a pair of annular grooves 524 respectively formed in the necks 523. The clamping members 6 are respectively received within the annular grooves 524 in the necks 523 for clamping the necks 523 on the motor 4. The motor 4 is formed with an annular recess 41 in an outer surface thereof. As assembly of the center of the ring plate 522 and the necks 523 of the elastic member 52 is fitted within the recess 41 when the elastic member 52 is sleeved over the motor 4.

In this embodiment, each of the clamping members 6 has a shape of a C-ring, and the elastic member 52 of the vibration-absorbing 5 is made of rubber. Since the elastic member 52 is molded on only one piece (i.e., the rigid support 51), the manufacturing process of the fan motor of the present invention is simpler than that of the above-mentioned conventional fan motor.

Figure 1:
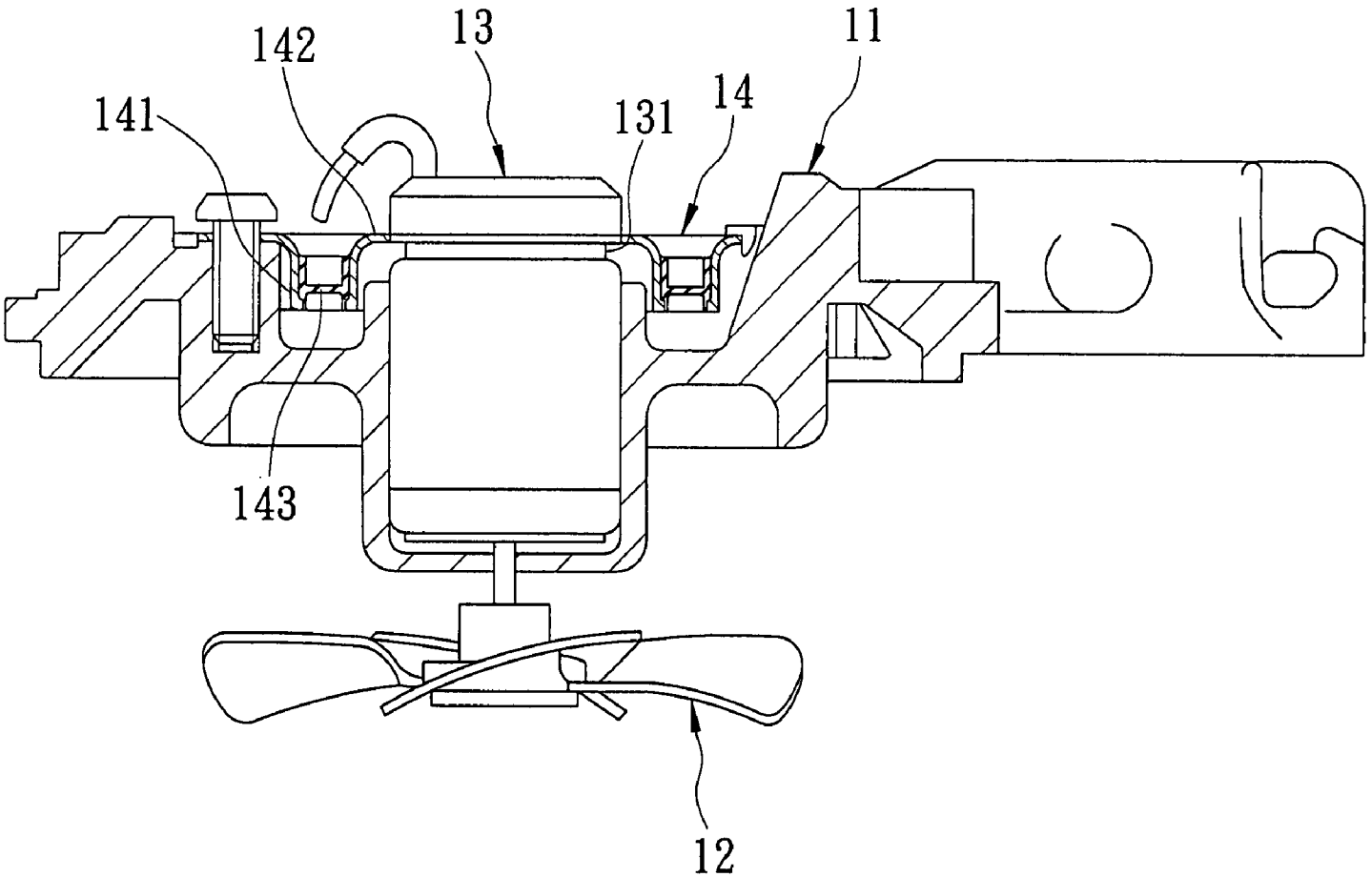
FIG. 1 PRIOR ART
FIG. 1 is a schematic sectional view of a conventional fan motor for use in a combustion-powered tool disclosed in Taiwanese Patent Publication Number 401342.

Furthermore, unlike the conventional fan motor shown in FIG. 1, while no rigid ring 142 is required in the present invention, the structural integrity of the fan motor is still maintained. As a result, the number of the components of the fan motor is reduced. That is, the fan motor of the present invention has a simpler structure.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A fan motor adapted to be mounted in a combustion-powered tool, the combustion-powered tool having a housing, said fan motor comprising:

a fan unit;

a motor for driving said fan unit;

a vibration-absorbing unit including a rigid support that is adapted to be mounted fixedly in the housing of the combustion-powered tool, and an elastic member sleeved over said motor and molded on said rigid support such that said rigid support is disposed around said elastic member, said elastic member being disposed between said rigid support and said motor for absorbing vibrations generated by said motor; and a clamping unit including at least one clamping member sleeved over said elastic member for clamping and retaining said elastic member on said motor.

2. A fan motor as claimed in claim 1, wherein:

said elastic member is unitary, and includes a ring plate that has top and bottom surfaces, a through-hole formed through a center of said ring plate, a pair of necks respectively formed on inner peripheries of said top and bottom surfaces of said ring plate, and a pair of annular grooves respectively formed in said necks; and said clamping unit includes a pair of said clamping members respectively received within said annular grooves in said necks for clamping said necks on said motor.

3. The fan motor as claimed in claim 2, wherein said motor is formed with an annular recess in an outer surface thereof, an assembly of said center of said ring plate and said necks of said elastic member being fitted within said recess when said elastic member is sleeved over said motor.

4. The fan motor as claimed in claim 1, wherein each of said clamping members has a shape of a C-ring.

5. The fan motor as claimed in claim 1, wherein said elastic member of said vibration-absorbing is made of rubber.

* * * * *